US008118773B2

(12) United States Patent
Stewart

(10) Patent No.: US 8,118,773 B2
(45) Date of Patent: Feb. 21, 2012

(54) ORAL ADMINISTRATION DEVICE

(75) Inventor: Bradley M. Stewart, Westfield, MA (US)

(73) Assignee: Tyco Healthcare Group LP, Mansfield, MA (US)

( * ) Notice: Subject to any disclaimer, the term of this patent is extended or adjusted under 35 U.S.C. 154(b) by 1242 days.

(21) Appl. No.: 11/385,177

(22) Filed: Mar. 21, 2006

(65) Prior Publication Data

US 2007/0225638 A1 Sep. 27, 2007

(51) Int. Cl.
*A61J 7/00* (2006.01)

(52) U.S. Cl. ..... 604/79

(58) Field of Classification Search ..... 215/11.1, 215/11.5; 606/234, 235, 236; 604/76, 77, 604/78, 79, 87, 88, 90; 222/206
See application file for complete search history.

(56) References Cited

U.S. PATENT DOCUMENTS

| | | | | |
|---|---|---|---|---|
| 3,590,722 | A * | 7/1971 | Leptrone | 99/532 |
| 3,892,243 | A | 7/1975 | Bell | |
| 4,078,566 | A | 3/1978 | Urban, Jr. | |
| 4,192,307 | A | 3/1980 | Baer | |
| D294,297 | S | 2/1988 | Roehrig | |
| 5,078,734 | A | 1/1992 | Noble | |
| D326,151 | S | 5/1992 | Wallace | |
| 5,123,915 | A | 6/1992 | Miller | |
| 5,127,903 | A | 7/1992 | Mailot | |
| 5,176,705 | A | 1/1993 | Noble | |
| D335,187 | S | 4/1993 | Stege | |
| 5,354,274 | A | 10/1994 | Demeter | |
| 5,363,890 | A * | 11/1994 | Yeung et al. | 141/364 |
| 5,512,047 | A | 4/1996 | Dvorak | |
| 5,514,142 | A | 5/1996 | Dean-Homolka | |
| 5,601,605 | A | 2/1997 | Crowe | |
| D391,642 | S | 3/1998 | Fountain | |
| 5,728,137 | A | 3/1998 | Anderson-Fignon | |
| 5,772,685 | A * | 6/1998 | Crowe et al. | 606/236 |
| 5,827,527 | A | 10/1998 | Leonard | |
| D404,885 | S | 2/1999 | Tomaszewski | |
| 5,891,165 | A | 4/1999 | Buckner | |
| 6,110,193 | A | 8/2000 | Chen | |
| 6,126,679 | A * | 10/2000 | Botts | 606/236 |
| 6,197,044 | B1 | 3/2001 | Clayton | |
| 6,454,788 | B1 | 9/2002 | Ashton | |
| 6,482,225 | B1 | 11/2002 | Bingham | |
| D476,085 | S | 6/2003 | Dumont | |
| 6,575,999 | B1 | 6/2003 | Rohrig | |
| 6,588,613 | B1 * | 7/2003 | Pechenik et al. | 215/11.1 |
| D492,417 | S | 6/2004 | Davis | |
| 6,752,824 | B2 | 6/2004 | Yancy | |
| 6,776,157 | B2 | 8/2004 | Williams | |
| D501,256 | S | 1/2005 | Roehrig | |
| 6,863,681 | B2 | 3/2005 | Dickerson | |
| 2003/0034031 | A1 | 2/2003 | Lev | |
| 2004/0040556 | A1 | 3/2004 | Fillyaw | |
| 2004/0178163 | A1 | 9/2004 | Kerns | |
| 2005/0125038 | A1 | 6/2005 | Inbar | |

FOREIGN PATENT DOCUMENTS

WO WO 03/051271 * 6/2003

* cited by examiner

*Primary Examiner* — Christopher D Koharski
(74) *Attorney, Agent, or Firm* — Lisa E. Winsor, Esq.

(57) ABSTRACT

An oral administration device having a nipple member and a frangible seal is disclosed. And oral administration system having a nipple member and a syringe to fill the nipple member is disclosed. An oral administration device having a vacuum package surrounding the oral administration device is also disclosed.

21 Claims, 3 Drawing Sheets

ORAL ADMINISTRATION DEVICE

FIELD OF THE INVENTION

This invention relates generally to oral administration devices, more particularly to an oral administration device for administering a variety of oral therapeutics including, but not limited to sweeteners, medicants, and vitamins to neonates or juveniles. Also, this invention relates to oral administration systems.

BACKGROUND OF RELATED ART

Administering oral therapeutics to juveniles, particularly neonates is problematic. Juveniles and neonates often squirm and are uncooperative when adults attempt to administer oral therapeutics. This can cause therapeutics to be spilled or wasted. Additionally, when a therapeutic is spilled or wasted it becomes difficult to determine the quantity of therapeutic that a juvenile or neonate has ingested. Moreover, when therapeutics that are to be administered in certain quantities are spilled before the juvenile or neonate ingests the therapeutic, a medical practitioner or parent may be unsure that the child has received the correct dose, making the treatment less effective.

Additionally, it is important that the device does not become contaminated when used multiple times. For example, when a practitioner gives sweetener to calm a neonate before a painful procedure, many practitioners dip the pacifier into a container of sweetener. This container generally becomes contaminated when the pacifier has to be dipped several times.

Some prior art administration devices require the practitioner to manipulate the package of the oral administration device in order to cover the administration device with a therapeutic. This manipulation can be tedious because the practitioner must make sure that enough therapeutic has coated the oral administration device. Moreover, this prior art device could be messy if the practitioner tries to coat the oral administration device more than one time. Another prior art method requires a practitioner to fill the oral administration device prior to administering to the neonate. This can be tedious if the therapeutic is spilled when poured into the device. These prior art methods also make it difficult to determine whether the juvenile or neonate received the correct dose of a particular therapeutic. Therefore, what is needed is an oral administration device where the therapeutic is contained in the oral administration device and force applied by the neonate's mouth will cause the sweetener to be expelled. Additionally, it would be beneficial to have an oral administration system that allows a practitioner to easily fill the device prior to administration.

SUMMARY

The present disclosure relates to an oral administration device for administering a variety of oral therapeutics including, but not limited to sweeteners, medicants, and vitamins to neonates or juveniles. The oral administration device comprises a nipple member for insertion into the juvenile's or neonate's mouth. In one embodiment, the nipple member has a frangible seal. Applied pressure causes the frangible seal to rupture allowing a therapeutic contained in the nipple member to escape. In another embodiment, the nipple member is surrounded by a vacuum package. The vacuum package prevents therapeutic contained in the nipple from leaking out of the nipple member prior to administration. The present invention also relates to an oral administration system that comprises an oral administration device including a nipple member and a syringe. The syringe allows the oral administration device to be filled with a therapeutic prior to administration. Also, the present invention relates to a method of delivering a therapeutic using an oral administration device.

Additional features of the invention will become apparent to those skilled in the art upon consideration of the following detailed description of the preferred embodiments exemplified in the best mode of carrying out the invention as presently perceived.

DETAILED DESCRIPTION OF THE PREFERRED EMBODIMENTS

The present invention relates to an oral administration device for administering a variety of oral therapeutics including, but not limited to sweeteners, medicants, and vitamins to neonates or juveniles. With reference to the drawings, the oral administration device comprises a nipple member. In a preferred embodiment the nipple member includes a frangible seal. The frangible seal is manufactured to break when force is applied to the nipple member, preferably by the neonate or juvenile when sucking or chewing on the oral administration device. The ruptured frangible seal allows a therapeutic contained in the nipple to escape and enter the juvenile or patients mouth.

In another embodiment the nipple member is surrounded by a vacuum package. During the manufacturing process a vacuum is applied to the package surrounding at least the nipple member to create a sealed package that surrounds the oral administration device. The vacuum package prevents leakage of a therapeutic contained in the nipple and also keeps the nipple from becoming contaminated during the distribution process.

In yet another embodiment an oral administration system provides for an oral administration device having a nipple and a syringe to fill the nipple prior to administration.

Figure 1:
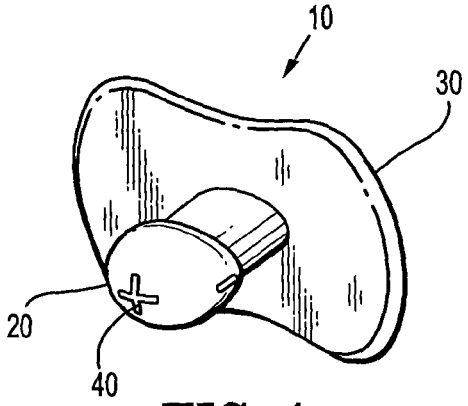
FIG. 1 is a perspective view of an oral administration device according to the present disclosure.
Figure 2:
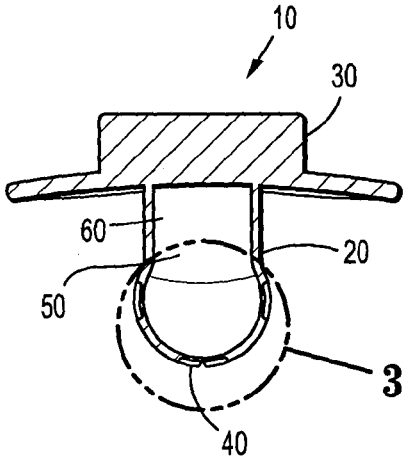
FIG. 2 is a plan view of an oral administration device according to the present disclosure.

With reference to the drawings, FIGS. 1-5 illustrate an oral administration device in accordance with the present disclosure. The oral administration device 10 comprises a nipple member 20. The nipple member 20 is connected to a base member 30. In FIG. 1 and FIG. 2 oral administration device 10 comprises nipple member 20 having a frangible seal 40. Nipple member 20 may be formed from any number of flexible materials known in the art including natural and synthetic polymers. Nipple member 20 may be formed from natural polymers including but not limited to natural rubbers, and polyisoprene. Also, nipple member 20 may be formed from a variety of thermoset, thermoplastic, or UV initiated polymers including but not limited to silicone, polyurethane, polyvinyl chloride, latex, and synthetic polyisoprene. Nipple member 20 is preferably formed from polyurethane and silicone. Nipple member 20 has a hollow section 50. Hollow section 50 can contain a therapeutic 60. Therapeutic 60 can include, but is not limited to sweeteners, medicants, and vitamins. Nipple 20 can be filled with therapeutic during the manufacturing process.

Figure 3:
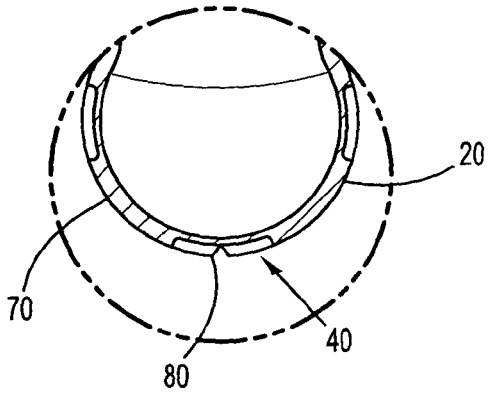
FIG. 3 is a partial enlarged view of the nipple member of an oral administration device
Figure 4:
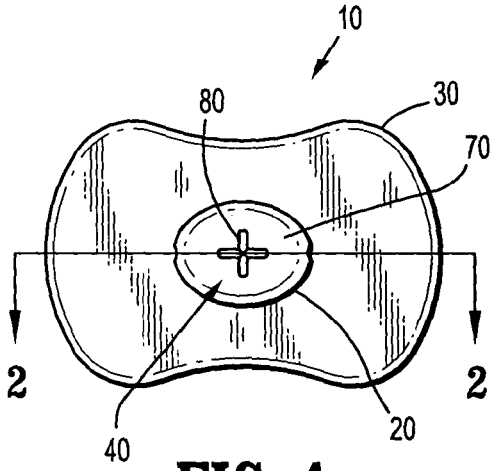
FIG. 4 is a plan view of the oral administration device according to the present disclosure.
Figure 5:
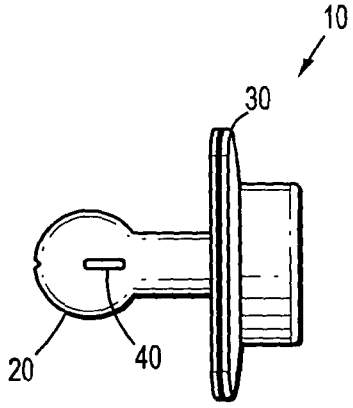
FIG. 5 is a plan view of an oral administration device according to the present disclosure.

Frangible seal 40 is shown in detail in FIG. 3 and FIG. 4. Frangible seal 40 is a seal which is intended to be broken, torn, or cut and which is thereby destroyed as a closure thereafter. Frangible seal 40 can be ruptured preferably by force created from the reflexive chewing or sucking action initiated by the neonate. Alternatively, frangible seal 40 can be ruptured by piercing frangible seal 40 with a sharp object. Frangible seal 40 prevents the therapeutic 60 from leaking out of the nipple member during distribution prior to administration. The tip 70 of nipple member 20 is shown in FIG. 3 and FIG. 4. In FIG. 3 and FIG. 4, tip 70 includes the nipple member 20 molded with frangible seal 40. Frangible seal 40 is an area of the nipple member molded to be thinner than the remaining area of nipple member 20. Thinner area 80 allows for the nipple to be easily ruptured with pressure or through piercing. In FIG. 4, thinner area 80 is a cross shaped slit. Alternatively, frangible seal 40 could be in the shape of a horizontal slit, vertical slit, oval, circular, or any variety thereof. As shown in FIG. 5, frangible seal 40 can be located anywhere on the nipple member that assists in administering therapeutic 60. Additionally, nipple member 20 can have multiple frangible seals.

When therapeutic 60 contained in nipple member 20 comprises a sweetener, the sweetener can be formulated from a wide variety of pharmaceutically acceptable or food acceptable components. Possible sweeteners include, but are not limited to, sucrose or fructose. Sweeteners can also include both caloric and/or noncaloric sweeteners. Medicants or vitamins can also be administered according to the present invention. Therapeutic 60 can be combined with starches, gums, gelatins and the like to provide a sufficient therapeutic composition for oral administration in accordance with the present invention.

Figure 6:
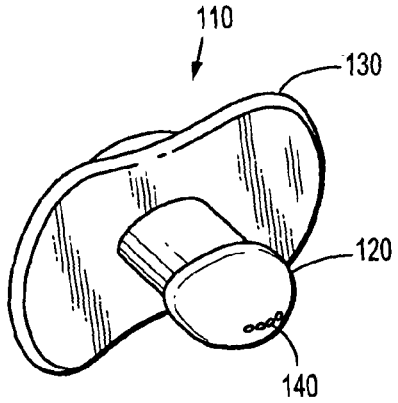
FIG. 6 is perspective view of another embodiment of an oral administration device according to the present disclosure.
Figure 7:
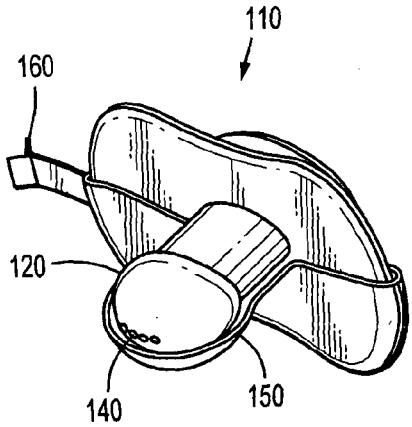
FIG. 7 is a perspective view of another embodiment according to the present invention including a vacuum package.
Figure 8:
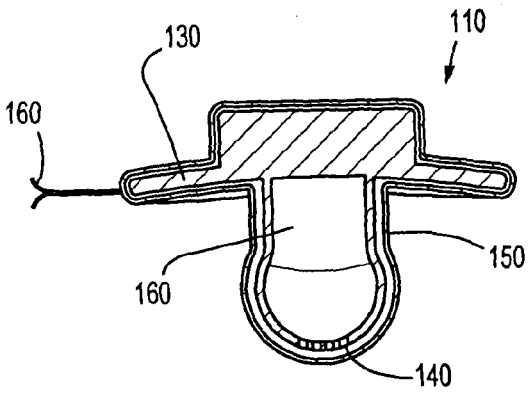
FIG. 8 is a plan view of another embodiment according to the present invention including a vacuum package.

FIG. 6, FIG. 7, and FIG. 8 illustrate an alternative embodiment of the oral administration device of the present disclosure. FIG. 6 depicts oral administration device 110 prior to packaging processes. Oral administration device 110 has nipple member 120 connected to base 130. Nipple member 120 has pierced holes 140. Pierced holes 140 can be in a variety of patterns and shapes. Additionally, pierced holes 140 can be a single hole. Nipple member 120 can alternatively be molded with a frangible seal. The vacuum packaging 150 surrounding oral administration device 110 is shown in FIG. 7 and FIG. 8. Vacuum packaging can be accomplished in a variety of ways well know in the art. Preferably, during manufacturing, two pieces of vacuum packaging acceptable material are placed over the oral administration device. The two pieces of material are sealed together. As shown in FIG. 8 a vacuum is applied to the package and the two pieces tightly surround the oral administration device 110 to prevent therapeutic 160 from leaking from nipple member 120. An adult can remove vacuum package 150 by pulling or tearing vacuum package 150 before use. Preferably, vacuum package 150 will include a tab 160 to remove vacuum package 150. The packaging material of vacuum package 150 can be any sealable material. The packaging material of vacuum package 150 is preferably polyethylene.

Figure 9:
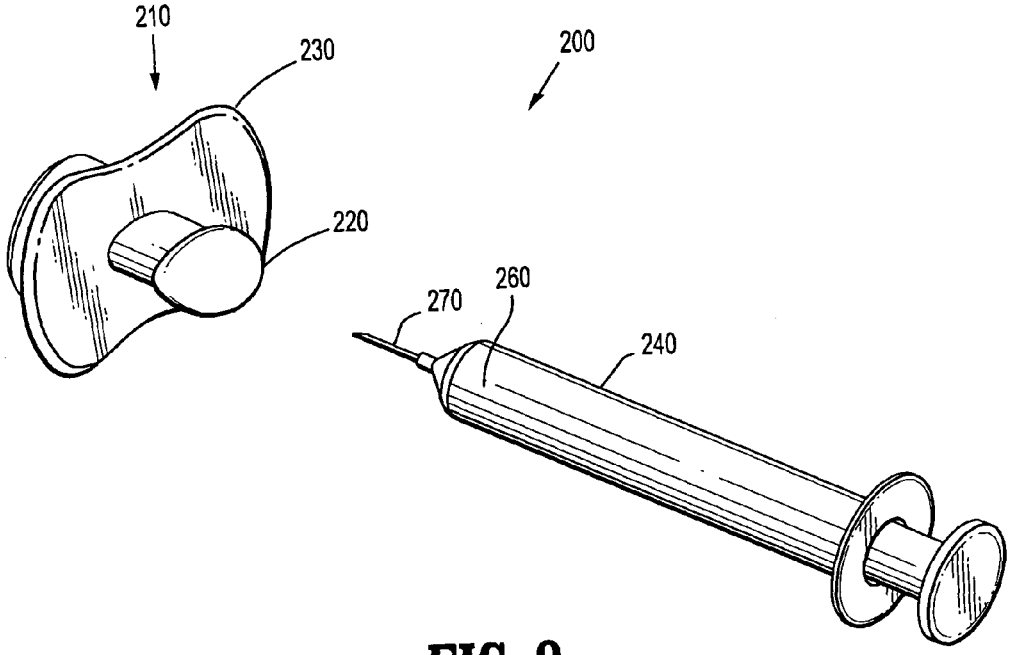
FIG. 9 is a perspective view of another embodiment including a syringe.
Figure 10:
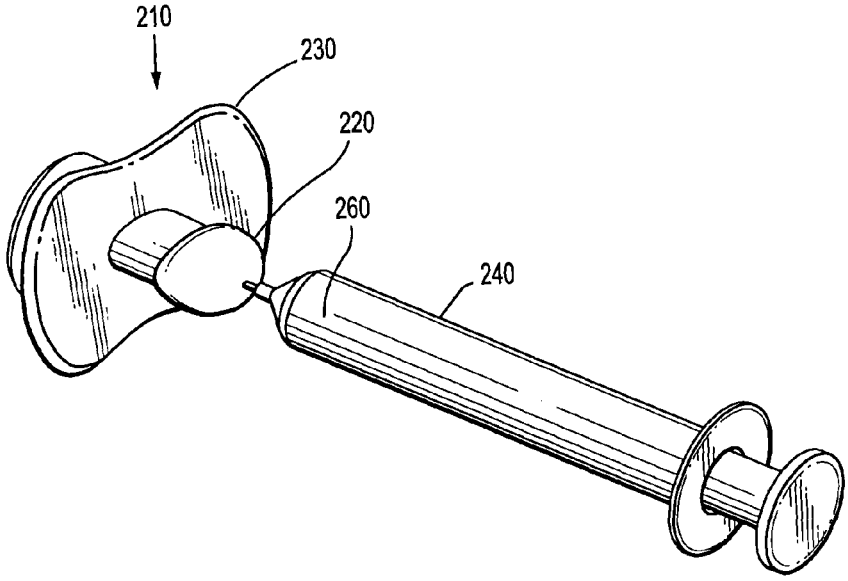
FIG. 10 is a perspective view of another embodiment including a syringe.

Another embodiment is shown in FIGS. 9 and 10. FIG. 9 and FIG. 10 illustrate an oral administration system 200. Oral administration system 200 comprises an oral administration device 210 having a nipple member 220. Nipple member 220 is connected to base 230. Oral administration system 200 also has a syringe 240. Syringe 240 includes needle 270. Syringe 240 can be a variety of syringes, needles, and combinations thereof such as MONOJECT needles and syringes available from Tyco Healthcare Group LP. Syringe 240 is filled with therapeutic 260. Therapeutic 260 can include, but is not limited to, sweeteners, medicants, and vitamins. During manufacturing syringe 240 is filled with therapeutic 260. Alternatively, syringe 240 can be filled by an adult after prior to administration. As shown by FIG. 10, syringe 240 pierces nipple member 220. Alternatively, base member 230 can be constructed to allow oral administration device 210 to be filled through base member 230. An adult can fill the syringe with an appropriate amount of therapeutic 260. The oral administration device 210 is given to an infant or neonate for administration of therapeutic 260.

Preferably, syringe 240 is equipped with a large gauge needle such as a 16 or 18 gauge needle. Syringe 240 can be used to pierce nipple member 220 one or more times to provide a sufficient passageway for administration of therapeutic 260.

In light of the foregoing disclosure of the invention and description of the preferred embodiments, those skilled in this area of technology will readily understand that various modifications and adaptations can be made without departing from the scope and spirit of the invention.

I claim:

1. An oral administration device comprising:

a base member; and a nipple member extending from the base member, the nipple member including an outer wall having a bulbous surface, the outer wall exposed to the interior of the patient's mouth upon at least partial positioning therein, the bulbous surface having a frangible seal defined therein, the frangible seal extending partially along the bulbous surface and arranged to be positioned in the patient's mouth, and being dimensioned and adapted to at least partially rupture when subjected to a predetermined force during administration in the patient's mouth.

2. The device of claim 1 wherein the base member is attached to a handle.

3. The device of claim 1 wherein the nipple member comprises a sweetener.

4. The device of claim 3 wherein the sweetener is selected from the group consisting of sucrose, fructose, and mixtures of caloric and/or noncaloric sweeteners.

5. The device of claim 1 wherein the nipple member comprises a medicant.

6. The device of claim 1 wherein the nipple member comprises a vitamin.

7. The device of claim 1 wherein the nipple member comprises a flexible material.

8. The device of claim 7 wherein the flexible material is a natural polymer.

9. The device of claim 7 wherein the flexible material is a synthetic polymer.

10. The device of claim 9 wherein the synthetic polymer is polyurethane.

11. The device of claim 9 wherein the synthetic polymer is silicone.

12. The device of claim 1 wherein the outer wall of the nipple member comprises a flexible material.

13. A method of using the oral administration device of claim 1 comprising administering the oral administration device.

14. The device of claim 13 wherein the outer wall of the nipple member defines an internal cavity.

15. The device of claim 14 including a therapeutic fluid within the internal cavity.

16. The device of claim 15 wherein the therapeutic fluid includes one of a sweetener, medicant or vitamin.

17. The device of claim 1 wherein the frangible seal includes a wall segment having a cross-sectional thickness which is less than the cross-sectional thickness of wall segments adjacent the frangible seal.

18. The device of claim 17 wherein the frangible seal includes at least one of a: horizontal slit, vertical slit, oval slit, circular slit, and combinations thereof.

19. The device of claim 1 wherein the frangible seal is dimensioned and adapted to rupture upon subjected to a predetermined suction force when in the patient's mouth.

20. An oral administration device comprising:

a base member; and a nipple member extending from the base member, the nipple member including an outer wall having a bulbous surface and being dimensioned for at least partial positioning in a patient's mouth, the bulbous surface defining a frangible seal that extends partially therealong, the frangible seal being exposed to the interior of the patient's mouth upon positioning of the nipple member therein, the frangible seal being dimensioned and adapted to at least partially rupture when subjected to a predetermined suction force during administration in the patient's mouth.

21. An oral administration device comprising:

a base member; and a nipple member extending from the base member, the nipple member including an outer wall having a bulbous surface and being dimensioned for at least partial positioning in a patient's mouth, the bulbous surface defining a frangible seal that extends along a portion of the bulbous surface, the frangible seal being disposed external of the base member and dimensioned and adapted to be exposed to the interior of the patient's mouth upon at least partial positioning of the frangible seal in the patient's mouth, the frangible seal being dimensioned and adapted to at least partially rupture when subjected to a predetermined force during administration in the patient's mouth.

* * * * *